US006286394B1

(12) United States Patent
Kark

(10) Patent No.: US 6,286,394 B1
(45) Date of Patent: Sep. 11, 2001

(54) ARRANGEMENT FOR CHANGING THE NUT HOLDING A ROLL RING

(76) Inventor: Uwe Kark, Moisburber Hang 6, 21149 Hamburg (DE)

( * ) Notice: Subject to any disclaimer, the term of this patent is extended or adjusted under 35 U.S.C. 154(b) by 0 days.

(21) Appl. No.: 09/453,013

(22) Filed: Dec. 2, 1999

(30) Foreign Application Priority Data

Jun. 7, 1999 (EP) ..... 99110883

(51) Int. Cl.[7] ..... B25B 13/00
(52) U.S. Cl. ..... 81/57.36; 81/56
(58) Field of Search ..... 81/57.15, 57.33, 81/57.36, 56

(56) References Cited

U.S. PATENT DOCUMENTS

| | | | | |
|---|---|---|---|---|
| 3,128,990 | * | 4/1964 | Brooks et al. | 254/29 A |
| 3,425,256 | | 2/1969 | McGoogan et al. | 72/239 |
| 3,679,173 | * | 7/1972 | Sherrick et al. | 254/29 A |
| 4,438,901 | * | 3/1984 | Reneau et al. | 254/29 A |
| 4,581,911 | * | 4/1986 | Shinomoto | 72/35 |
| 4,581,956 | * | 4/1986 | Robert | 81/57.38 |
| 4,653,304 | * | 3/1987 | Feldmann et al. | 72/239 |
| 4,706,485 | | 11/1987 | Gilvar et al. | 72/239 |
| 4,879,927 | | 11/1989 | Sevelinge | 81/56 |
| 5,964,128 | * | 10/1999 | Kaneyama et al. | 81/56 |

FOREIGN PATENT DOCUMENTS

| | | |
|---|---|---|
| 32 26 694 A1 | 1/1984 | (DE) . |
| 35 15786 A1 | 11/1986 | (DE) . |
| 0 142 879 A1 | 5/1985 | (EP) . |
| 0 343 440 B1 | 5/1989 | (EP) . |

* cited by examiner

*Primary Examiner*—Joseph J. Hail, III
*Assistant Examiner*—David B. Thomas
(74) *Attorney, Agent, or Firm*—Alix, Yale & Ristas, LLP

(57) ABSTRACT

Arrangement for changing the nut (11), the latter holding a roll ring, on a cantilever-mounted roll shaft (2) having a thread (13) for the nut (11), by means of a changeover apparatus. This has a threaded sleeve (50) which is provided with a thread **(12*a*) that matches the thread (13) of the roll shaft (2) in order to take the nut (11). It has a centring device (49) for placement in alignment against the roll shaft (2). To ensure that the nut (11) can be screwed onto the roll shaft (2) from the threaded sleeve (50) even when the position of their threads does not match exactly, the threaded sleeve is moveable and inhibited against rotation in relation to the centring device (49) and/or in relation to the roll shaft (2)**.

12 Claims, 4 Drawing Sheets

ARRANGEMENT FOR CHANGING THE NUT HOLDING A ROLL RING

BACKGROUND OF THE INVENTION

To reduce the time requirement for changing rolling mill rolls and similar components, the use of changeover apparatuses which are placed against the roll stand and make it easier to remove a component to be replaced and to insert a new component is known (EP-A-142 879). The invention is directed towards an arrangement which makes it easier to change a nut holding a roll ring on a cantilever-mounted roll shaft having a thread for the nut. This applies particularly to nuts which contain devices for the hydraulic clamping of the roll ring and are accordingly large and heavy and require precise handling (EP-B-343 440).

SUMMARY OF THE INVENTION

According to this, an arrangement for changing such a nut comprises a changeover apparatus which has a threaded sleeve which bears a thread that matches the thread of the roll shaft. This sleeve takes the nut to be placed on the roll shaft. The threaded sleeve is fitted with centring devices for placing it in alignment against the roll shaft. To ensure that the nut can be unscrewed from the sleeve and screwed onto the roll shaft, the sleeve is inhibited against rotation relative to the centring device and/or the roll shaft. For example, an anti-rotation device or frictional engagement can be provided between the sleeve and the centring device. The centring device as such is secured against rotation, for example by virtue of the fact that it is connected to supporting devices or by positive or frictional engagement with the roll shaft. To ensure that the nut can be readily unscrewed from the sleeve and screwed onto the roll shaft, it is necessary that the position of the sleeve thread relative to the shaft thread should be precisely matched. To avoid the design complexity associated with this matching process, the invention envisages that the threaded sleeve should be axially moveable in relation to the centring devices and/or the roll shaft. As soon as the nut reaches the shaft thread as it is unscrewed from the sleeve, this axial mobility of the sleeve allows it to assume the axial position which matches the shaft thread. The threaded sleeve is preferably axially moveable to ensure that rotational inhibition of the threaded sleeve will readily allow the nut to be unscrewed. However, it is also conceivable that the rotational inhibition should be provided by a friction force, the torque of which is higher than the torque exerted on the threaded sleeve as the nut is unscrewed. Instead of an axial movement, a rotary movement of the threaded sleeve is also possible.

The prior art provides many possible embodiments for the centring device. A particularly advantageous one consists in the centring device being formed by a changeover shaft which carries the threaded sleeve and can be clamped against the end of the roll shaft. The axial mobility of the threaded sleeve covers at least one unit of lead of the thread. Within the extent of its axial movement, it is expediently held by spring force in an initial position, from which the yielding movement which may be required when the nut thread strikes the shaft thread is possible. If the threads are designed in such a way that a correction of the axial position in each of the two axial directions may by chance become necessary, it is expedient, for example, that the threaded sleeve be urged by spring force into an initial position from which it can yield in both directions. In another embodiment, the arrangement is such that the sleeve is urged by spring force into an initial position at the shaft end of its travel and that when the centring device is placed against the shaft end, the thread end of the nut rests under this spring force against the thread end of the shaft, the sleeve yielding to a greater or lesser extent counter to this spring force.

The changeover apparatus according to the invention can be used profitably even when it is only a question of changing the nut. Generally, however, it is equipped to accept and change further components, in particular for changing further nuts and, if appropriate, roll rings. In this case, a plurality of nut changeover apparatuses is connected to one another in a geometrical relationship coinciding with a plurality of roll shafts by a framework which carries the said apparatuses. To enable the centring devices to assume their exact end position on the respectively associated roll shaft, despite positional tolerances, it is expedient if they are secured on the framework in such a way as to be axially moveable and axially preloaded by springs. The framework is then placed against the roll stand in such a way that the centring devices move onto the ends of the roll shafts under the spring preloading.

The changeover apparatus is not only provided for mounting but also for removing the rolling mill components. As regards the removal of the roll rings, it should be noted that, even after the nuts holding them have been released, they still stick very firmly on the roll shaft and must therefore be released, initially with very high forces, from this frictional engagement before they can be removed from the roll shaft with lower forces. To avoid the changeover apparatus having to supply the high forces required to release the frictional engagement of the roll rings, the invention envisages that a device for releasing the roll ring be provided on the roll shaft, this device expediently being formed as a piston/cylinder device on that side of the roll ring which is remote from the free end of the roll shaft. It is expedient if this forms part of a ring mounted between the roll ring and a collar of the roll shaft.

BRIEF DESCRIPTION OF THE DRAWINGS

The invention will be explained in greater detail below with reference to the drawing, which illustrates an advantageous embodiment example and in which.

DETAILED DESCRIPTION OF A PREFERRED EMBODIMENT

Figure 1:
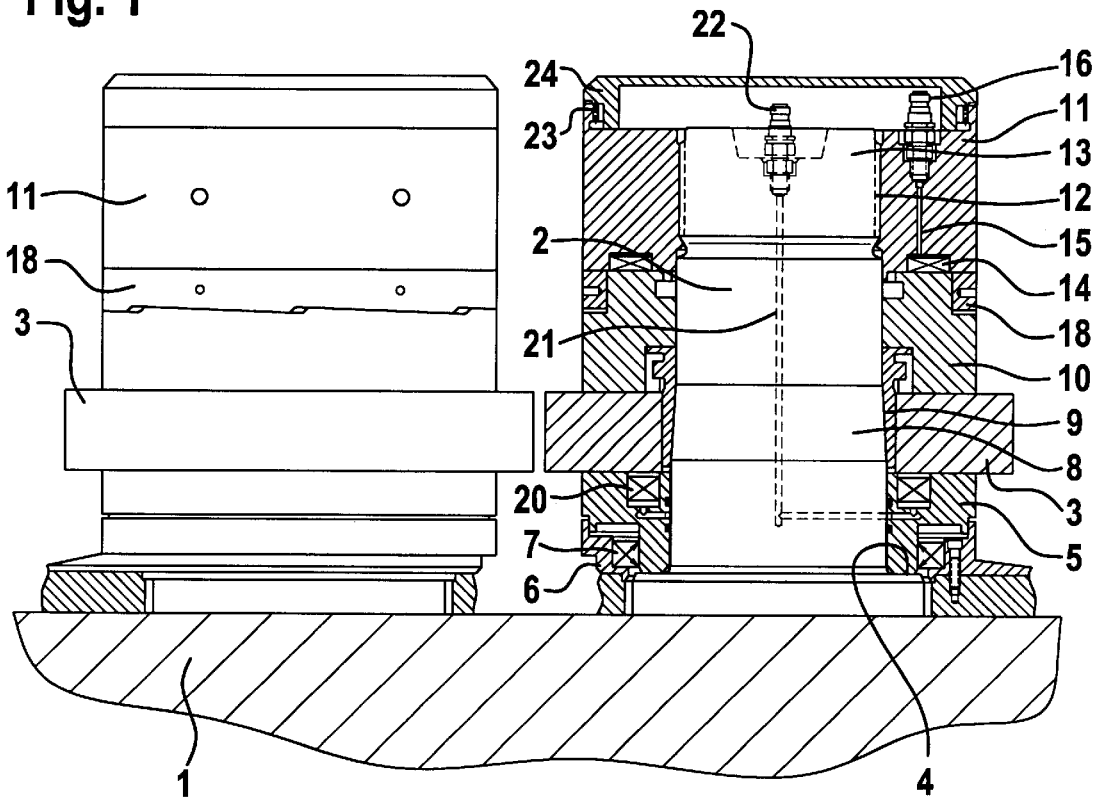
FIG. 1 shows a view of part of a roll stand with two rolls arranged next to one another.

The roll stand comprises a frame, which is indicated only in part and in schematic form at 1 and from which there project two parallel roll shafts 2 which carry interacting roll rings 3 provided at the circumference with a rolling profile (not shown). During rolling, the shafts 2 are driven synchronously in opposite directions. Near to the frame 1, they have a shaft collar 4, on which there rests an inner support ring 5 that supports the inner end of the roll ring 3. A sealing collar 6 which, together with the support ring 5, encloses a sealing arrangement 7 is firmly connected to the frame 1.

To centre the roll ring 3, the roll shaft 2 has in the region of the roll ring a conical portion 8, on which is seated a taper sleeve 9 that interacts in a centring manner with the inner circumferential surface of the roll ring 3. The details of this arrangement are known and therefore do not require any further explanation. There follows an outer support ring 10, which is pressed against the outer end of the roll ring 3 by a nut 11. The thread of the nut 11 interacts with a thread 13 on the roll shaft. When mounted, the roll ring 3 is thus clamped between the support rings 5 and 10 by the action of the nut 11 and is thereby held in a rotationally fixed manner on the roll shaft 2.

In its end face interacting with the outer support ring 10, the nut 11 contains an annular piston 14 which can be connected via a passage 15 and a connection nipple 16 to a source (not shown) of pressurized oil. Once the parts have been assembled in the manner shown, the annular piston 14 is subjected to pressure, thereby subjecting the outer support ring 10 to the clamping force envisaged. This state is then assured by rotating a wedging ring 18 provided between the ends of the nut 11 and of the support ring 10. The clamping force envisaged is then assured by means of the wedging ring 18. For a further explanation of this arrangement, attention is drawn to EP Patent 343 440.

Once the centring device 8, 9 has been assembled, the roll ring 3 firmly grips the roll shaft 2. To allow it to be removed more easily, the inner support ring 5 contains a plurality of hydraulic pistons 20 distributed over its circumference, it being possible to connect these hydraulic pistons to a source (not shown) of pressurized oil by means of a passage 21 and a nipple 22. When the nut 11 is loosened and pressurized oil is passed to the pistons 20, the roll ring 3 together with the taper sleeve 9 can thereby be displaced slightly towards the free end of the shaft, thereby releasing the frictional engagement and allowing removal to continue with a lower expenditure of force.

At its free end, the nut 11 has a gear ring 23, the purpose of which will be explained later. During rolling, the free end of the nut 11 and the roll shaft 2 is protected by a cover 24.

Figure 2:
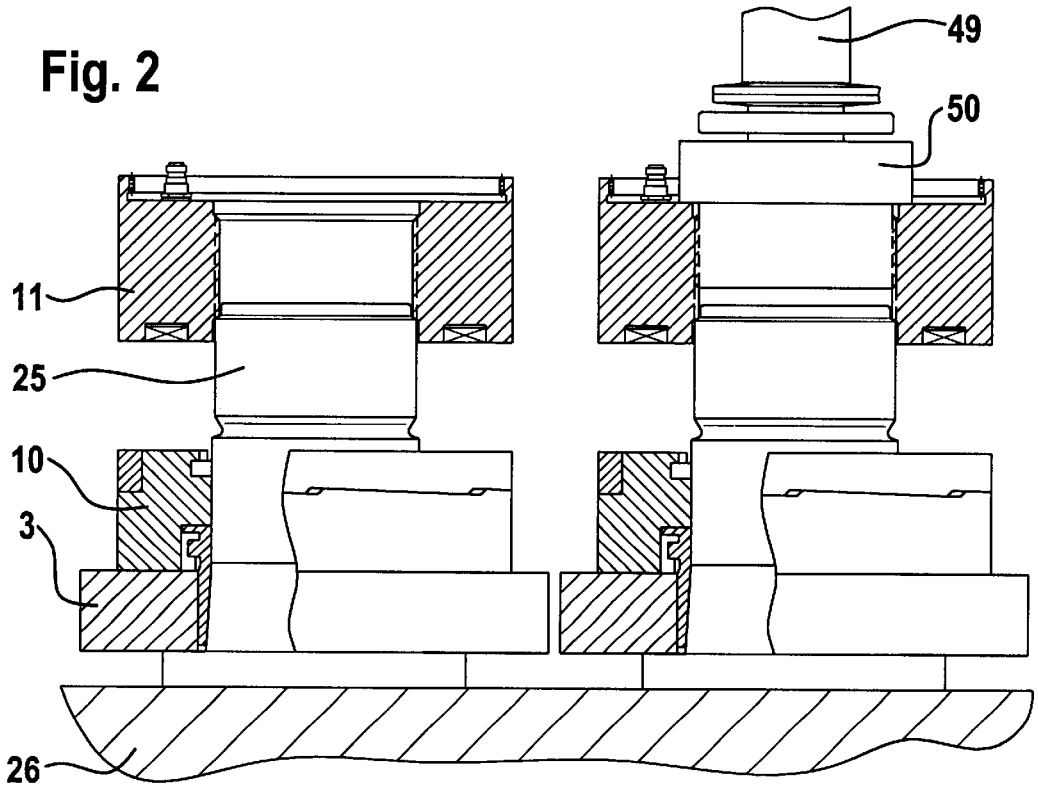
FIG. 2 shows a premounting arrangement.

To reduce the time required for the mounting work to be performed on the roll stand, a premounting arrangement in accordance with FIG. 2 is provided for premounting the roll rings 3, the outer support rings 10 and the nut 11. This premounting arrangement is formed by two journals 25, which are held on a base plate 26, the shape of which corresponds to the roll shafts 2 and the geometrical arrangement of which relative to one another is identical to that of the roll shafts 2. The components to be mounted on the roll stand are first of all assembled on the premounting arrangement, as shown in FIG. 2. This arrangement corresponds exactly to that in which the components are to be mounted on the roll shafts in the mounting operation. A changeover apparatus which simultaneously receives all the components on the premounting arrangement is used to transfer them from the premounting arrangement to the roll shafts.

This changeover apparatus can be seen in greater detail in the following figures. It comprises a framework consisting of longitudinal bars 30 and transverse bars 31. It has a manipulator coupling 32, which is used for connection to a manipulator which effects the transportation of the changeover apparatus from the premounting arrangement to the roll stand and the accurate placement of the changeover apparatus against the roll stand. The framework furthermore has a roll-stand coupling 33 which allows the changeover apparatus to be connected to the frame of the roll stand in such a way that the components held by the changeover apparatus are in accurate alignment with the roll shafts on which they are to be placed. A device is provided to allow the changeover apparatus to be displaced parallel to the direction of the roll shafts 2 and it comprises, for example, guide rods 34 which each slide in a guide sleeve 35 which is connected rigidly to the frame of the roll stand or can be coupled to it. In addition, an actuator (not shown), in the form of a piston/cylinder device for example, can be provided to allow the apparatus to be moved in the direction of guidance predetermined by the members 34, 35. When the changeover apparatus is placed against the roll stand, the components held by the changeover apparatus are initially in a position in which they are at a distance from the roll shafts but are in alignment with them, and are then pushed onto the roll shafts by the said movement of the changeover apparatus. This brings them into the position shown in FIG. 3 for the left-hand roll shaft, in which position the roll ring 3 and the outer support ring 10 are already approximately in the desired mounting position, while the nut 11 is close to that end of the roll shaft which bears the thread 13.

Figure 4:
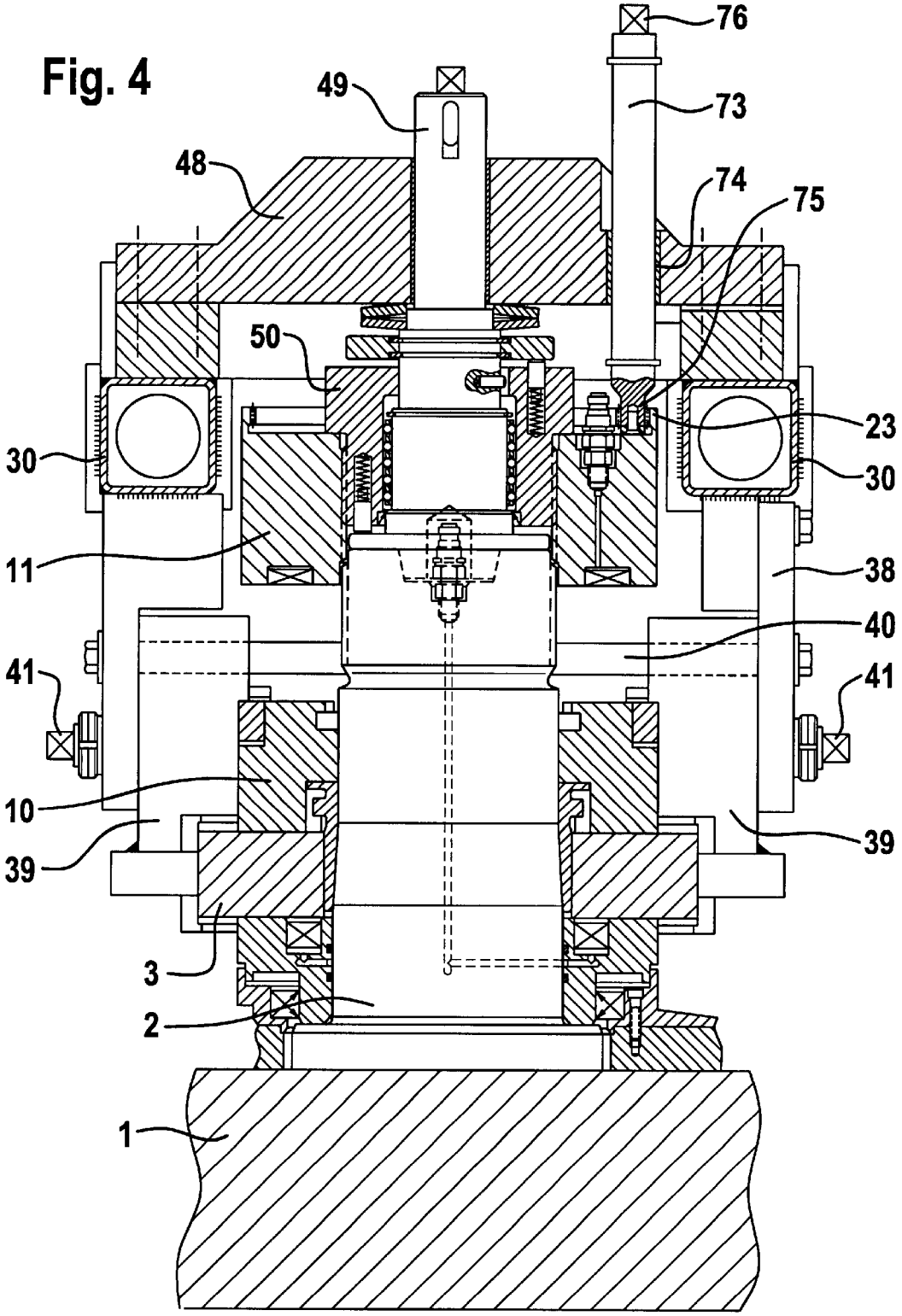
FIG. 4 shows a section along the line II—II in FIG. 3.

To enable the components to be held, the changeover apparatus is provided with holding devices for the individual components. The holding device for a roll ring 3 and an outer support ring 10 is shown in FIG. 4. Projecting down from the longitudinal bars 30 are arms 38, which are connected rigidly to the latter and on which two claws 39 are mounted displaceably on guide rods 40 and a threaded spindle 41 in such a way that they can be moved towards and away from one another by turning the spindle 41. Once the components have been mounted on the journals 25 of the premounting arrangement, the changeover apparatus is driven over the premounting arrangement and the roll ring 3 and the outer support ring 10 are clamped in the changeover apparatus by means of the claws 39. They can thus be raised from the premounting arrangement with the changeover apparatus and placed against the roll stand.

The holding device for the nut 11 is formed by a transverse piece 48 connected to the longitudinal bars 30 (FIG. 4), a changeover shaft 49 mounted in the said transverse piece, and a threaded sleeve 50 carried by the said shaft. The details can be seen in FIG. 5.

The changeover shaft 49 is held in a sliding bearing 51 of the transverse piece 48. It is fixed axially, on the one hand, by a Belleville arrangement 52, which is supported on a shaft collar, and, on the other hand, by a releasable wedge 53, which is accommodated in a slot in the changeover shaft.

The threaded sleeve 50 is mounted in an axially moveable manner on the lower, free end of the changeover shaft 49 by means of a rolling bearing 54. However, it is non-rotatable relative to the changeover shaft 49 because a pin 57 projecting from the shaft engages in a longitudinal groove 58 in the threaded sleeve.

A plate 55 is secured on the changeover shaft 49 above the threaded sleeve 50. A plurality of holes (only one of which is shown), each containing a spring pin 60, is distributed over the circumference in that end of the threaded sleeve 50 which faces the said plate. The spring pins 60 interact with the plate 55 and urge the threaded sleeve 50 away from the plate 55. Below the threaded sleeve 50, the changeover shaft 49 carries a plate 61. That end of the threaded sleeve which faces the said plate contains a plurality of holes (only one of which is shown), containing spring pins 62, distributed over its circumference. These press against the plate 61 and urge the threaded sleeve 50 away from the plate 61. If there are no other forces acting on the threaded sleeve 50, it therefore adopts a central position between the plates 55 and 61, from which it can be displaced axially towards one plate or the other counter to spring force.

Figure 3:
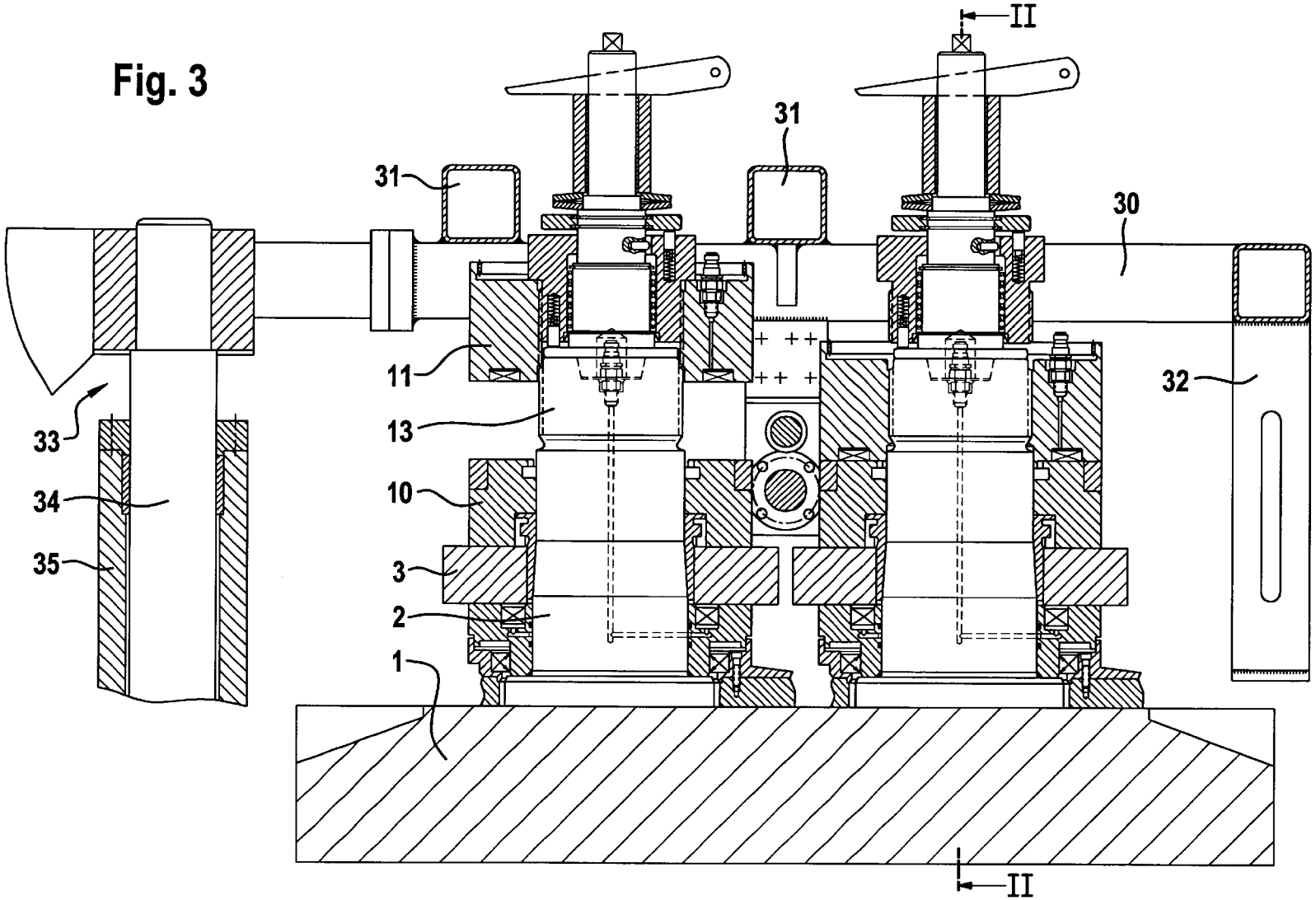
FIG. 3 shows the arrangement in accordance with FIG. 1 with a changeover apparatus mounted.
Figure 5:
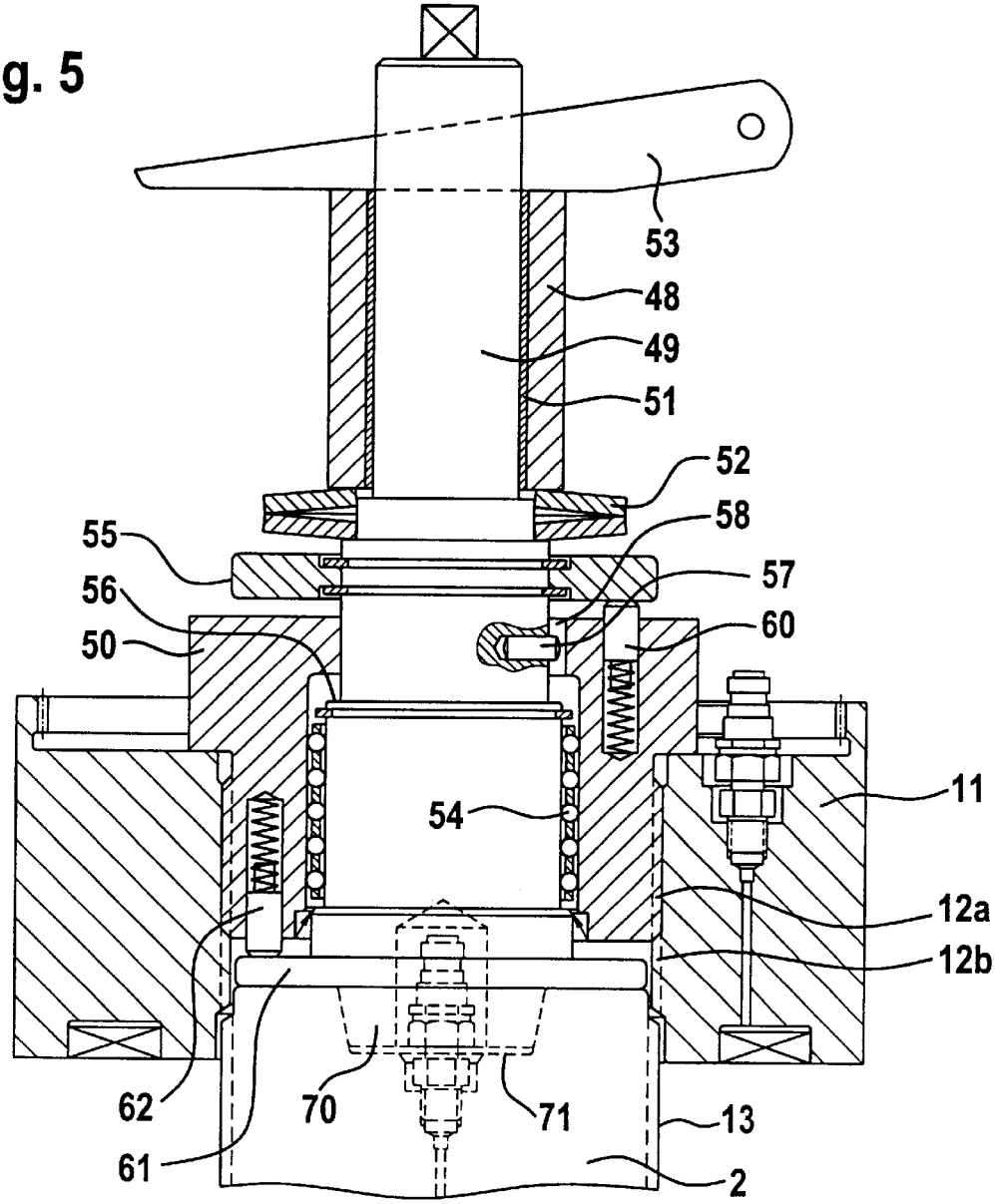
FIG. 5 shows a partial section through the changeover apparatus on an enlarged scale and FIG. 6 shows a schematic representation of a development of the thread of the nut and of the roll shaft.

On its outer circumference, the threaded sleeve 50 bears a thread 12*a* which matches the thread 12*b* of the nut 11. FIG. 5 and FIG. 3 on the left show the nut 11 screwed onto the threaded sleeve 5. This is the position occupied by the nut after it has been moved up against the changeover shaft by the changeover apparatus. To allow the nut 11 in the premounting arrangement to be connected more easily to the nut-holding device, the latter can be released from the framework of the changeover apparatus. For this purpose, the wedge 53 is released and the changeover shaft is pulled out of the bearing 49 of the transverse piece 48. The threaded sleeve 50 can then be screwed easily into the nut 11 situated in the premounting arrangement, as shown on the right in FIG. 2. When both nuts in the premounting arrangement have been provided with the associated nut-holding devices, the framework of the changeover apparatus can be lowered onto the premounting arrangement, connected to the nut-holding devices and secured by means of wedge 53. Once the roll rings have been gripped by the claws 39, the changeover apparatus can be removed with the components held by it from the premounting arrangement.

Once the changeover apparatus has been connected to the roll stand, the roll rings 3 and the outer support rings 10 are first of all pushed onto the roll shaft 2—as explained above. In the process, the lower end of each changeover shaft 49 approaches the free end of the associated roll shaft 2. On the free end of the changeover shaft there is a conical centring projection 70, and in the free end of the roll shaft 2 there is a corresponding conical centring hole 71. In the end position of the changeover apparatus, they engage in one another and ensure that the changeover shaft 49 is in accurate alignment with the roll shaft 2. To ensure that this end position can be reached even when there are dimensional tolerances between the roll stand and the changeover apparatus, the spring 52 is provided. Its flexibility allows the end position of the changeover apparatus to be chosen in such a way that, at all events, both changeover shafts 49 rest against the ends of the associated roll shafts 2, the shafts being held in contact by the force of the spring 52.

As soon as the changeover apparatus has reached this end position, the nut 11 must be unscrewed from the threaded sleeve 50 and screwed onto the thread 13 of the roll shaft. For this purpose, a pinion shaft 73 is inserted (see FIG. 4) through a guide hole 74 in the transverse piece 48, the guide hole 74 being arranged in such a way that the pinion 75 provided on the free end of the pinion shaft 73 comes into engagement with the gear ring 23 of the nut 11. A drive device can now be placed against the rear end 76 of the pinion shaft 73, and the nut 11 thereby rotated.

When the front end of the thread 12*b* reaches the start of the thread 13 on the roll shaft, it cannot be expected that the position of the thread will match precisely. On the contrary, the wedge-shaped ends of the thread flights generally meet, attempting to displace each other in one axial direction or the other. The invention allows this displacement thanks to the axial displaceability of the threaded sleeve 50 on the changeover shaft 49. The two threads can thus adjust to one another axially and the nut 11 can be screwed onto the thread 13 on the roll shaft without the operating personnel having to attend to the accurate mutual alignment of the thread flights.

The meeting of the thread flights is explained with reference to FIG. 6. This shows a development of the two thread flights in a relative position which they occupy by chance at the moment when their ends 80, 81 meet. As is generally the case with the ends of threads, the said ends are bounded on the outside by a surface 82 and 83, respectively, extending in the circumferential direction and, on the rear side, by the normal thread flank 84. Given this shape, the surface components 82, 83 extending in the circumferential direction almost always meet. If it is assumed that the roll-shaft thread illustrated at the bottom is fixed and the upper thread of the nut turns from right to left in the drawing, the movement of the upper thread is determined by the sliding contact of the surfaces 82, 83. This means that the upper thread can only turn but cannot progress in the axial direction. Only when the rear end 85 (on the right in the drawing) of the surface 83 has arrived at the front end 86 (on the left in the drawing) of the surface 82 can the upper thread flight enter the interspace of the lower thread flight and hence also progress axially.

While the upper thread is turning without an axial component in the direction of the surfaces 82, 83, it pushes the threaded sleeve 50 upwards against the force of the spring pin 60 by the amount 87. The distance 87 cannot be greater than the lead of the thread.

Figure 6:
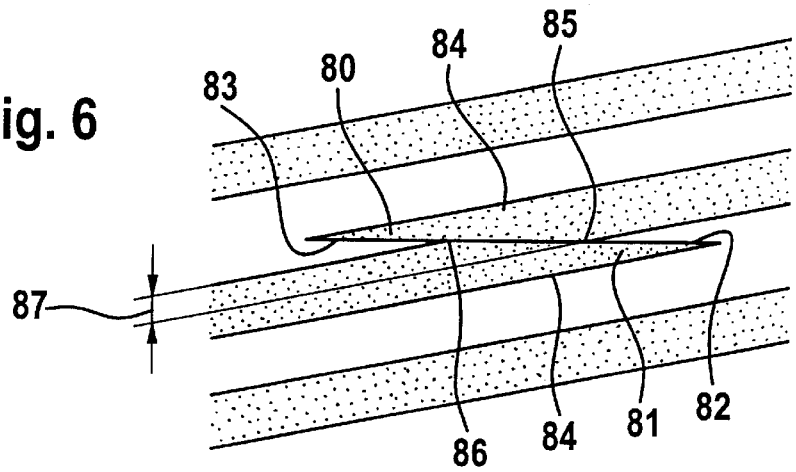

Given the thread shape shown in FIG. 6, the threaded sleeve 50 is displaced continually upwards. There is therefore no need of the downward movement allowed by the spring pins 62. It is nevertheless expedient to provide the spring pins 62 to enable the changeover apparatus to be used irrespective of the type of thread.

The device 57, 58 for preventing the threaded sleeve 50 from rotating relative to the changeover shaft 49 is provided to prevent the threaded sleeve from co-rotation as the nut 11 is unscrewed. Instead of preventing rotation of the threaded sleeve, inhibition of rotation is sufficient in many cases, for example by means of a friction force greater than the torque exerted on the threaded sleeve as the nut is unscrewed.

In the embodiment example, provision is made for the threaded sleeve to yield axially if the thread flights do not meet in a suitable way. Yielding in the circumferential direction is also possible instead. For example, the threaded sleeve can be connected rigidly to the changeover shaft in the axial direction and be capable of yielding in the circumferential direction counter to spring force or friction force. If the nut rotates without an axial movement when the thread flights meet, as explained with reference to FIG. 5, the threaded sleeve can then overturn the spring or friction resistance and co-rotate. As soon as the nut has reached the rotational position in which its thread fits that of the roll shaft, the rotary movement of the threaded sleeve ends.

The processes described above in relation to the mounting of the components on the roll shafts apply in a corresponding manner to removal. Here, the annular piston 14 is first of all hydraulically preloaded to allow the ring 18 to be released. Once the hydraulic pressure on the annular piston 14 has been relieved, the nut 11 is loosened slightly. The roll ring 3 together with the centring sleeve 9 is then released from its frictional engagement with the roll shaft 2 by hydraulic actuation of the piston/cylinder devices 20. The changeover apparatus can now be brought into position. The nut 11 is unscrewed from the threaded portion 13 and screwed onto the threaded sleeve 50. The roll ring 3 is gripped by means of the claws 39. The changeover apparatus is removed from the roll shafts and a second changeover apparatus, prepared in the meantime and carrying fresh components, is placed against the roll stand.

It is self-evident that the arrangement described is not dependent on the respective spatial position of the roll shafts. The changeover apparatus can be used both with a vertical and a horizontal shaft arrangement. The expressions "at the top" and "at the bottom" used above relate merely to the position in the drawing.

What is claimed is:

1. A changeover apparatus for changing a nut that secures a roll ring to a cantilever-mounted roll shaft having a first thread for the nut, said changeover apparatus comprising:

a framework; and a plurality of centering devices mounted to said framework for placing the nut in alignment against the roll shaft, each said centering device comprising a changeover shaft which carries a threaded sleeve having a second thread that matches the thread of the roll shaft, said threaded sleeve being axially moveable relative to said changeover shaft and roll shaft.

2. The apparatus of claim 1, wherein said roll shaft has a free end and said changeover shaft can be clamped against the free end of the roll shaft.

3. The apparatus of claim 1, wherein said first and second threads have a fixed number of threads per unit of axial length resulting in a first axial distance between threads and said threaded sleeve is capable of moving a second axial distance at least equal to said first axial distance.

4. The apparatus of claim 3, wherein said threaded sleeve is urged by spring force into an initial position from which the threaded sleeve can yield counter to the spring force by at least said first axial distance.

5. The apparatus of claim 1, wherein said roll shaft is part of a rolling mill, said rolling mill including a plurality of said roll shafts in a first geometrical arrangement and said apparatus includes an equal plurality of centering devices and maintains said centering devices in a second geometrical arrangement complementary to said first geometrical arrangement.

6. The apparatus of claim 5, wherein the threaded sleeves carried by said equal plurality of centering devices are urged by spring force into an initial position from which said threaded sleeves can yield counter to the spring force.

7. The apparatus of claim 1, wherein the apparatus comprises at least one holding device for a roll ring.

8. The apparatus of claim 7, wherein said roll shaft is provided with a release device for releasing a frictional engagement between the roll ring and the roll shaft.

9. The apparatus of claim 8, wherein said roll ring comprises an upper surface facing toward said roll shaft free end and an opposed lower surface facing away from said roll shaft free end and said release device comprises a ring including at least one cylinder with a piston disposed in said cylinder, said ring installed on said roll shaft so that said piston engages said roll ring lower surface.

10. The apparatus of claim 9, wherein said roll shaft includes a collar axially spaced from said roll shaft free end and said ring is mounted between said collar and said roll ring.

11. The apparatus of claim 1, wherein said threaded sleeve is rotationally fixed relative to said changeover shaft and roll shaft.

12. The apparatus of claim 1, wherein said threaded sleeve is sufficiently frictionally engaged with said changeover shaft to resist a rotational force exerted on the threaded sleeve by rotation of the nut so that said threaded sleeve remains stationary relative to said changeover shaft and roll shaft during nut rotation.

* * * * *